US008269695B2

(12) United States Patent
Kasai et al.

(10) Patent No.: US 8,269,695 B2
(45) Date of Patent: Sep. 18, 2012

(54) SELF-EMISSION TYPE DISPLAY DEVICE

(75) Inventors: Naruhiko Kasai, Yokohama (JP); Hajime Akimoto, Kokubunji (JP); Toshihiro Satou, Mobara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1459 days.

(21) Appl. No.: 11/640,845

(22) Filed: Dec. 19, 2006

(65) Prior Publication Data

US 2007/0229415 A1 Oct. 4, 2007

(30) Foreign Application Priority Data

Mar. 31, 2006 (JP) ..... 2006-096400

(51) Int. Cl.
*G09G 3/30* (2006.01)

(52) U.S. Cl. ..... 345/76; 345/77; 345/530; 345/536; 345/537; 345/543; 345/547; 345/82; 315/169.1; 315/169.3

(58) Field of Classification Search ..... 345/82, 345/36, 45, 39, 33, 76–78, 55–56, 530–574; 315/169.3, 169.1
See application file for complete search history.

(56) References Cited

U.S. PATENT DOCUMENTS

| | | | | |
|---|---|---|---|---|
| 6,873,117 | B2 * | 3/2005 | Ishizuka | 315/169.1 |
| 2003/0063053 | A1 * | 4/2003 | Yamazaki et al. | 345/82 |
| 2005/0029968 | A1 * | 2/2005 | Shimoda | 315/293 |

FOREIGN PATENT DOCUMENTS

JP 2004-287345 A 10/2004

* cited by examiner

*Primary Examiner* — Lun-Yi Lao
*Assistant Examiner* — Olga Merkoulova
(74) *Attorney, Agent, or Firm* — Antonelli, Terry, Stout & Kraus, LLP.

(57) ABSTRACT

A self-emission type display device is disclosed. A current comparator circuit (47) in a data line drive circuit having a current compensating function (2) detects only the result of size comparison between the current amount due to the degeneration of a self-emission element and a reference value. The reduction of the current amount below the reference value is stored by being added to the least significant bits of a display data storage circuit (30). In accordance with the display data read from the storage circuit (30), a D/A conversion circuit (41) generates a write signal voltage.

21 Claims, 10 Drawing Sheets

SELF-EMISSION TYPE DISPLAY DEVICE

INCORPORATION BY REFERENCE

The present application claims priority from Japanese application JP2006-096400 filed on Mar. 31, 2006, the content of which is hereby incorporated by reference into this application.

BACKGROUND OF THE INVENTION

This invention relates to a display device having mounted thereon a self-emission element providing a self-emission type display element such as an EL (electroluminescence) element or an organic EL element and a driving method thereof.

In the self-emission element typically including the EL (electroluminescence) element or the organic EL element, the emission brightness is proportional to the amount of the current flowing in the self-emission element, and the gradation display is made possible by controlling the amount of the current flowing in the self-emission element. A display device can be fabricated by arranging a plurality of these self-emission elements.

After the protracted use, however, the self-emission element is degenerated with time and the emission brightness thereof is reduced. The degree of degeneration depends on the length of emission time. In accordance with the emission state (display pattern) of each pixel, therefore, a sticking pattern is generated.

To obviate the sticking pattern generated by the temporal degeneration of the self-emission element, JP-A-2004-287345 discloses a technique in which the drive current of each pixel column (one column in vertical direction) is measured so that the degree of degeneration is detected from the current amount and the detection result is fed back to the signal voltage.

SUMMARY OF THE INVENTION

However, JP-A-2004-287345 contains no description of a specific configuration other than an ADC (analog-to-digital converter) constituting a current detection circuit for each pixel column and a memory capacitor for storing the result thereof. Especially, no consideration is given to the circuit size depending on the correction accuracy to a large measure. Neither the data correction based on the current detection result is specifically described.

The object of this invention is to provide a self-emission type display device and a driving method thereof in which the circuit size of the ADC, the memory capacitor and the data correction circuit can be reduced and the sticking correction effect can be produced.

According to this invention, only the result of comparison of the current amount due to the degeneration of the self-emission pixel with a reference value is detected, and the fact that the current amount is reduced below the reference value is stored by being added to the display data as a bit data, and a write signal voltage corresponding to the display data read from the storage circuit is generated thereby to drive the pixel. According to a first aspect of the invention, one degeneration correcting session is made possible by adding one bit or the minimum number of bit. According to a second aspect of the invention, the number of times the degeneration is corrected can be increased by increasing the number of bits.

It is also possible to detect the sticking state only in an arbitrary area by controlling the white display for degeneration detection to an arbitrary area on the display panel. In this case, the capacitance of the memory circuit can be further reduced. Also, the load capacitance of the current detection circuit can be reduced and the current detection accuracy improved by detecting the current in an arbitrary area.

According to this invention, the pixel degeneration can be detected with a small circuit size.

According to this invention, the result of pixel degeneration detection is added to the input display data and stored as a bit data, and therefore the storage capacity can be suppressed.

According to the first aspect of the invention, there is provided a self-emission type display device having a stable emission brightness between the pixels in which the sticking due to temporal degeneration can be suppressed.

According to the second aspect of the invention, there is provided a self-emission type display device in which the sticking can be suppressed for a longer time than in the first aspect by increasing the number of times the degeneration is detected and corrected.

DETAILED DESCRIPTION OF THE INVENTION

Now, first and second embodiments of the invention are explained.

First Embodiment

The first embodiment of the invention is explained in detail below with reference to the drawings.

Figure 1:
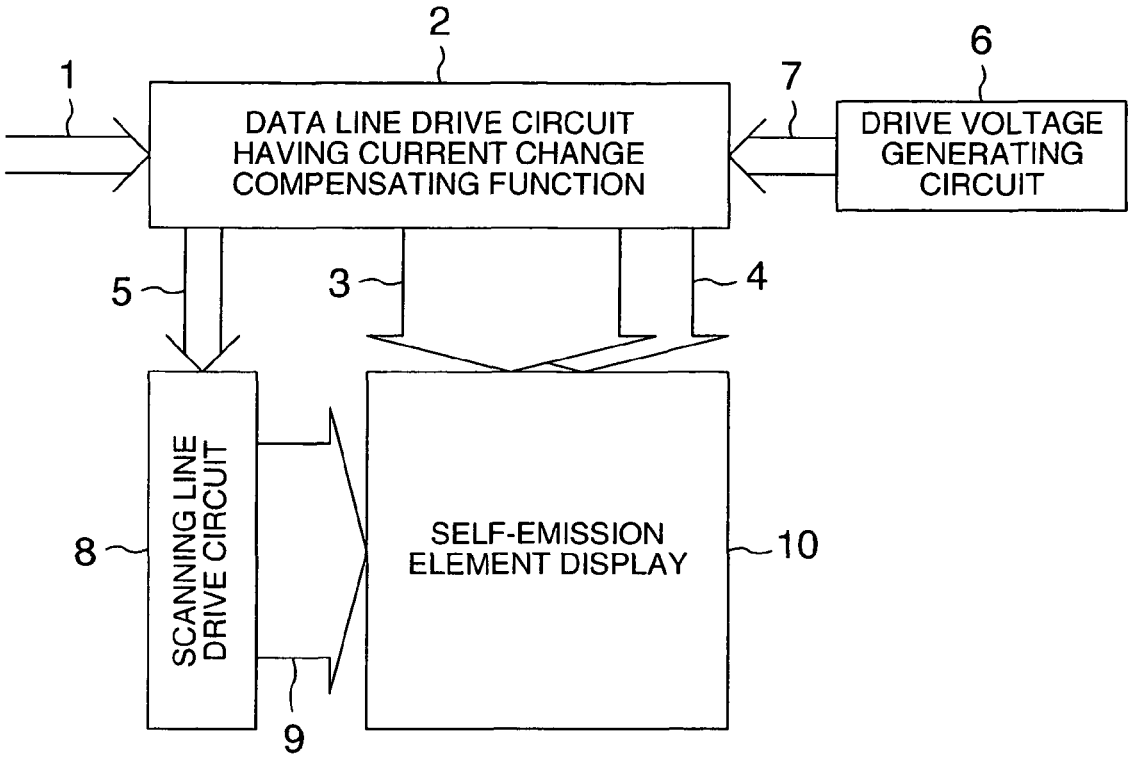
FIG. 1 shows an example of the self-emission element display device according to an embodiment of the invention.

FIG. 1 shows an example of the self-emission element display device according to an embodiment of the invention.

In FIG. 1, reference numeral 1 designates a display signal, numeral 2 a data line drive circuit having a current change compensating function, numeral 3 a data line drive signal, numeral 4 an emission source voltage and numeral 5 a scanning line control signal. The data line drive circuit having a current change compensating function 2, in accordance with the display signal 1, generates the data line drive signal 3 for supplying a gradation voltage to a self-emission element display (described later) and the emission source voltage 4 for supplying the source voltage to emit the light from the self-emission element which signals 3 and 4 are output to the self-emission element display (described later). Also, a scanning line control signal 5 to select the vertical scanning line for applying the gradation voltage is generated and output to a scanning line drive circuit (described later). In addition to the normal display operation described above, a display pattern for sticking detection is generated, a sticking point detected, the result thereof stored and the display signal corrected in accordance with the particular result, during a sticking detection period (described later). The sticking detection period may be determined arbitrarily for each frame period (one screen display period) or each horizontal scanning period. The sticking detection period can be set immediately after switching on power of the self-emission element display device (immediately after operation start) or after the circuit is stabilized after power switch on (after operation start).

According to this embodiment, the display pattern for sticking detection is assumed to be the total white display (maximum brightness display) in the description that follows. Numeral 6 designates an emission voltage generating circuit, and numeral 7 an emission control voltage. The emission voltage generating circuit 6 generates the voltage for the self-emission element display (described later) to emit light and the emission control voltage constituting a reference voltage (described later) for sticking detection and outputs them to the data line drive circuit having the current change compensating function 2. Numeral 8 designates a scanning line drive circuit, numeral 9 a scanning line drive signal, and numeral 10 a self-emission element display defined as a display (display panel) using the light emitting diode or the organic EL as a display element. The self-emission element display 10 has a plurality of self-emission elements (pixels) arranged in matrix. The display operation on the self-emission element display 10 is performed in such a manner that the data of the signal voltage corresponding to the data line drive signal 3 output from the data line drive circuit having the current change compensating function 2 is in written in the pixels selected and subjected to the write control by the scanning line drive signal 9 output from the scanning line drive circuit 8. The voltage for driving the self-emission elements is supplied as an emission source voltage 4. The data line drive circuit having the current change compensating function 2 and the scanning line drive circuit 8 may be implemented by different LSIs or a single LSI, and may be formed on the same glass substrate as the pixel unit. The current change compensating function can be implemented by a different LSI from the data line drive circuit 2. This embodiment is explained below on the assumption that the self-emission element display 23 has the resolution of 240×320 dots, and one dot is configured of three pixels of R (red), G (green) and B (blue) from left side, i.e. 720 pixels in horizontal direction of the display. In the self-emission element display 10, the brightness of the light emitted by the self-emission element can be adjusted by the amount of the current flowing in the self-emission element and the turn-on time of the self-emission element. The larger the amount of the current flowing in the self-emission element, the higher the brightness of the self-emission element. The longer the turn-on time of the self-emission element, the higher the brightness of the self-emission element.

Figure 2:
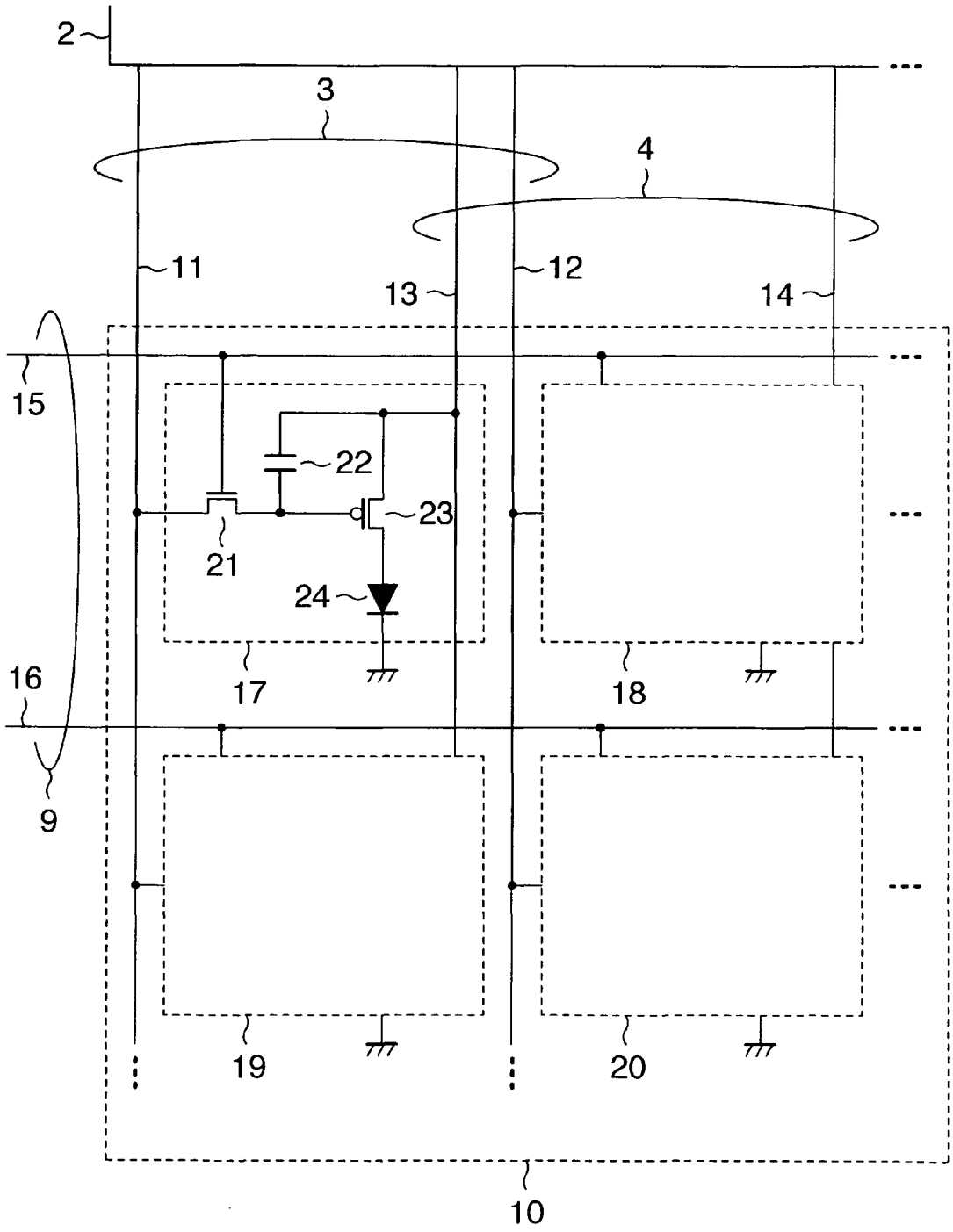
FIG. 2 shows the internal configuration of a self-emission element display 10 according to the embodiment of FIG. 1.

FIG. 2 shows the internal configuration of the self-emission element display 10 of FIG. 1 according to an embodiment. This example of the self-emission element display 10 uses the organic EL element as a self-emission element. In FIG. 2, numeral 11 designates a first dot R data line, numeral 12 a first dot G data line, numeral 13 a column-1 R emission power line, numeral 14 a column-1 G emission power line, numeral 15 a first row select line, numeral 16 a row-2 select line, numeral 17 a row-1 column-1 pixel, numeral 18 a row-1 column-2 pixel, numeral 19 a row-2 column-1 pixel, and numeral 20 a row-2 column-2 pixel. The first dot R data line 11 and the first dot G data line 12 are signal lines for inputting the first dot R signal and the first dot G signal (described later), respectively, to the pixels. The row-1 select line 15 and the row-2 select line 16 are signal lines for inputting the first scanning line select signal and the second scanning line select signal (described later), respectively, to the pixels. A signal voltage is written, through each data line, in the pixels on the row selected by each row select line, and the pixels are turned on by the emission source voltage supplied from the emission power line on each column according to the signal voltage thereby to control the pixel brightness. Although the internal configuration of only the row-1 column-1 pixel 17 is shown, the row-1 column-2 pixel 18, the row-2 column-1 pixel 19 and the row-2 column-2 pixel 10 also have a similar configuration.

Numeral 21 designates a data write switch, numeral 22 a write capacitor, numeral 23 a drive transistor, and numeral 24 an organic El. The data write switch 21 is turned on by the row-1 select line 15 to accumulate the signal voltage from the first dot R data line 11 in the write capacitor 22. The drive transistor 23 supplies the organic EL 24 with the drive current corresponding to the signal voltage accumulated in the write capacitor 22. The emission brightness of the organic EL 24, therefore, is determined by the signal voltage written in the write capacitor 22 and the emission source voltage supplied from the column-1 R emission power line. Also, since the resolution is 240×320 as explained above, the description that follows assumes that the number of pixels of the self-emission element display 10 is such that 320 horizontal row select lines 1 to 320 are arranged vertically, while a total of 720 data lines including 240 vertical power lines for each of R, G, B from dots 1 to 240 are arranged horizontally.

Figure 3:
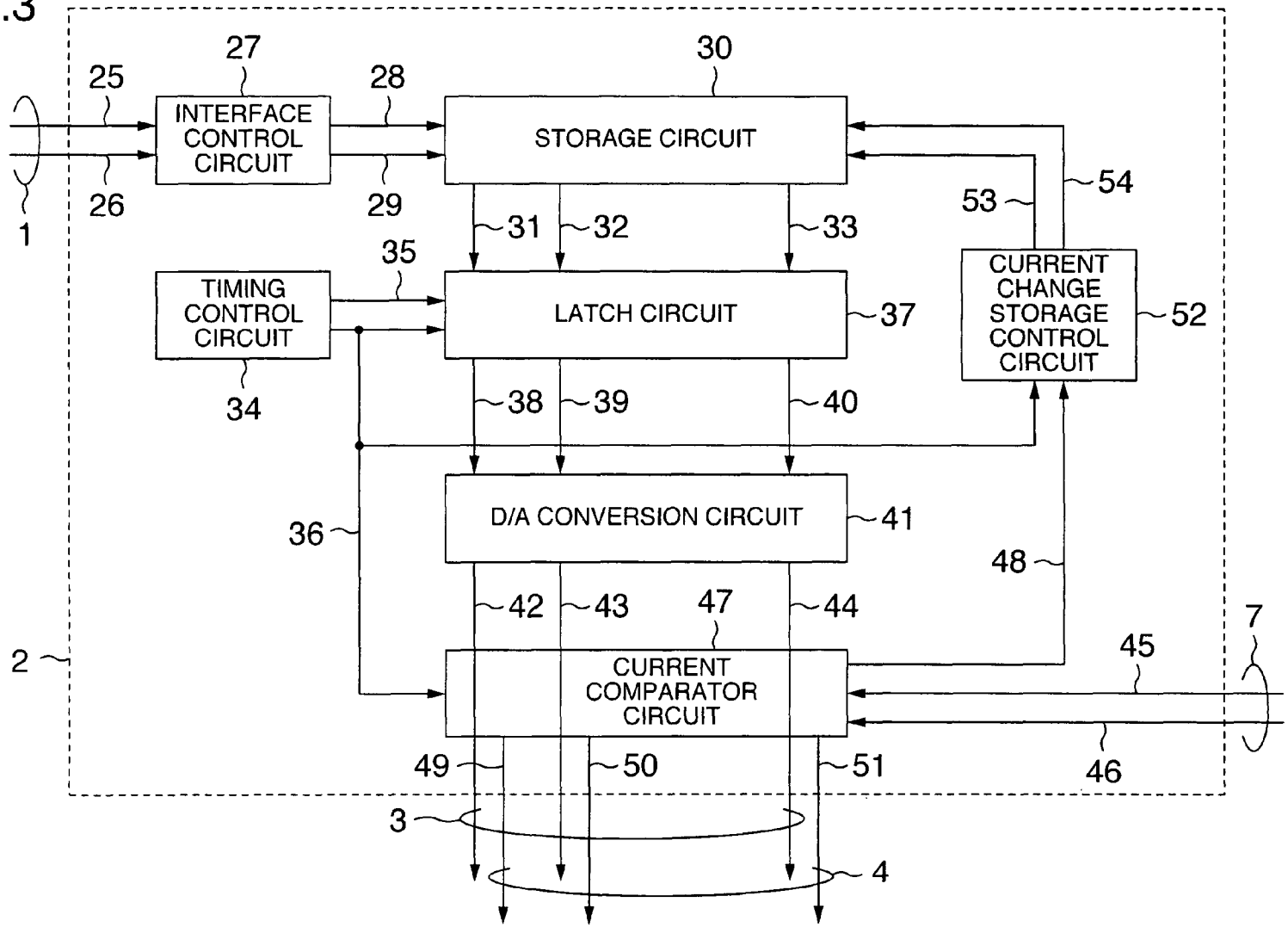
FIG. 3 shows the internal configuration of a data line drive circuit having the current change compensating function 2 of FIG. 1.

FIG. 3 shows the internal configuration of the data line drive circuit having the current change compensating function 2 of FIG. 1 according to an embodiment. Numeral 25 designates a data bus signal, numeral 26 a display control signal, numeral 27 an interface control circuit, numeral 28 a write data (digital display data), and numeral 29 an address control signal. The interface control circuit 27, like the conventional drive having a memory built therein, outputs the write data 28 and the address control signal 29 in accordance with the data bus signal 25 constituting the display data input from the system-side MPU and the display control signal 26 for controlling the writing of the data from the system and the reading of the display data to the display. Numeral 30 designates a storage circuit, numeral 31 a column-1 R read data, numeral 32 a column-1 G read data, and numeral 33 a column-240 B read data. The storage circuit 30, like the conventional driver having a memory built therein, stores the write data 28 in accordance with the write operation of the address control signal 29 on the one hand and reads the storage data in accordance with the read operation of the address control signal 29 corresponding to the display timing of the display on the other hand. Thus, 720 columns of data from the column-1 R read data 31, the column-1 G read data 32 to the column-240 B read data 33 are output. The storage circuit 30 is, for example, a RAM (random access memory) having the storage capacity of at least one screen of display data. Further, during the sticking detection period, the write operation is performed in accordance with the current change storage address signal and the current change storage data (both described later).

Numeral 34 designates a timing control circuit, numeral 35 a one horizontal latch timing signal, numeral 36 a sticking detection timing signal, numeral 37 a latch circuit, numeral 38 a column-1 R latch data, numeral 39 a column-1 G latch data, and numeral 40 a column-240 B latch data. The timing control circuit 34 generates the one horizontal latch timing signal 35 for latching and collectively outputting one horizontal row of the data read from the storage circuit 30 on the one hand and generates a sticking detection timing signal 36 for latching and collectively outputting one horizontal row of the sticking detection pattern (described later) during the sticking detection period on the other hand. The latch circuit 37, like in the conventional operation, latches one horizontal row of data from the column-1 R read data 31 and the column-1 G read data 32 to the column-240 B read data 33 and outputs them as the data including the column-1 R latch data 38, the column-1 G latch data 39 to the column-240 B latch data 40, while at the same time generating the total white display data and outputting the column-1 R latch data 38, the column-1 G latch data 39 to the column-240 B latch data 40 in accordance with the sticking detection timing signal 36 during the sticking detection period. The total white display data may alternatively be input from an external source to the interface control circuit 27. Numeral 41 designates a D/A conversion circuit, numeral 42 a column-1 R data line drive signal, numeral 43 a column-1 G data line drive signal and numeral 44 a column-240 B data line drive signal. The D/A conversion circuit 41, like in the conventional operation, converts the digital data including the column-1 R latch data 38, the column-1 G latch data 39 and the column-240 B latch data 40 into analog data, and outputs the column-1 R data line drive signal 42, the column-1 G data line drive signal 43 to the column-240 B data line drive signal 44.

Numeral 45 designates an emission power supply (analog current), numeral 46 a current reference (analog current), numeral 47 a current comparison circuit, numeral 48 a current comparison result, numeral 49 a column-1 R emission power supply, numeral 50 a column-1 G emission power supply, and numeral 51 a column-240 B emission power supply. The current comparison circuit 47 supplies a voltage of the emission power supply 45 to each column of the organic EL elements shown in FIG. 2 as the column-1 R emission power supply 49, the column-1 G emission power supply 50 and the column-240 B emission power supply 51 on the one hand, and at the time of sticking detection, compares the amount of current flowing in each column with the current reference 46 and outputs the current comparison result 48 on the other hand. The current comparison result 48 is, for example, the 1-bit data of one horizontal row of the detection result output by serial conversion. According to this embodiment, assume that a "1" signal is output in the case where the amount of the current detected is lower than the reference value. Nevertheless, a "0" signal may be output in place of a "1" signal. Numeral 52 designates a current change storage control circuit, numeral 53 a current change storage address control signal, and numeral 54 a current change storage data. The current change storage control circuit 52, in accordance with the sticking detection timing signal 36, generates the data and a control signal for storing the current comparison result 48 at the display position detected in the storage circuit 30, and outputs a current change storage address control signal 53 and a current change storage data 54. The storage circuit 30, the timing control circuit 34, the current comparison circuit 47 and the current change storage control circuit 52 make up a write data correction circuit to compensate for the display brightness.

Figure 4A:
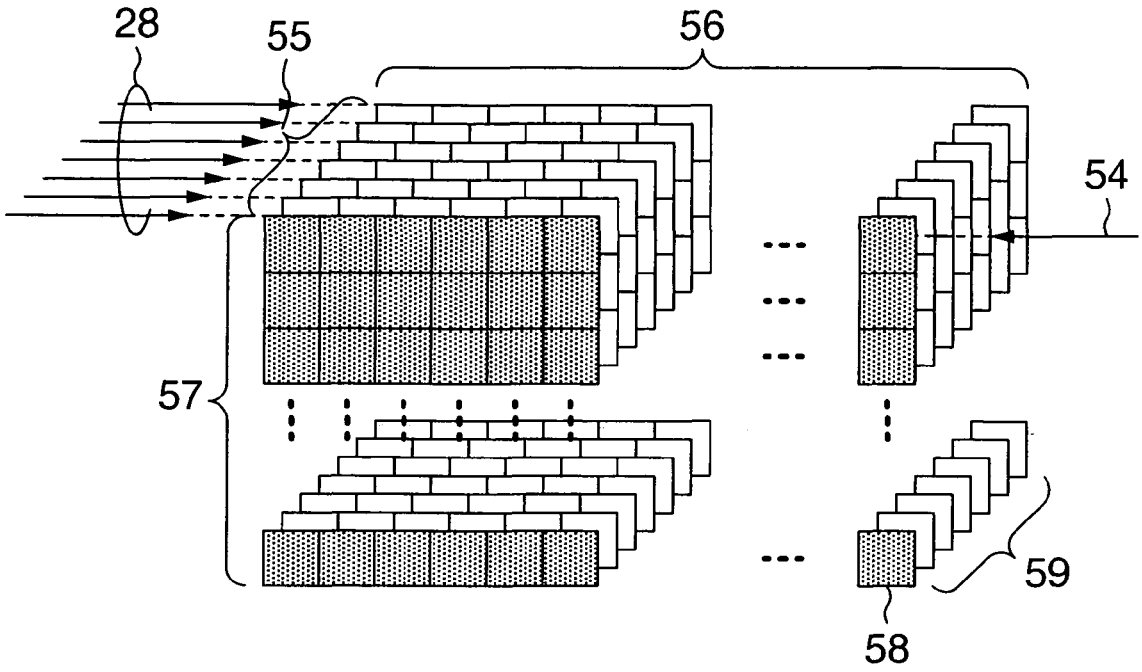
FIGS. 4A and 4B show a memory bit structure of a storage circuit 30 of FIG. 3 according to an embodiment.
Figure 4B:
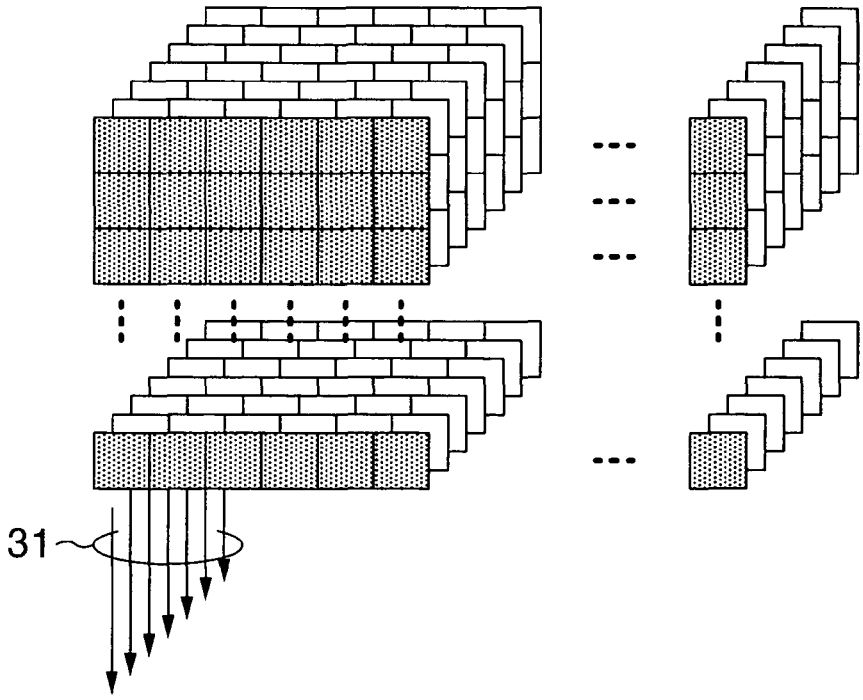

FIGS. 4A and 4B show the memory bit structure of the storage circuit 30 of FIG. 3 according to an embodiment, in which FIG. 4A shows the write operation and FIG. 4B the read operation. In FIG. 4, numeral 55 designates one-pixel information, numeral 56 a horizontal arrangement, numeral 57 a vertical arrangement, numeral 58 sticking information and numeral 59 input gradation information. The one-pixel information 55 corresponds to one display pixel of the output gradation information, and according to this embodiment, is assumed to be 7 bits in the description that follows. The horizontal arrangement 56 corresponds to the number of dots in horizontal direction of the display, and according to this embodiment, is assumed to be 720, while the vertical arrangement 57 corresponds to the number of dots in vertical direction and according to this embodiment, is assumed to be 320 in the description that follows. The one-pixel information 55 is divided into the one-bit sticking information 58 and the 6-bit input gradation information 59. At the time of write operation, the write data 28 is written in the input gradation information 59 and the current change storage data 54 in the sticking information 58 at an appropriate timing. At the time of read operation, on the other hand, the column-1 R read data 31 of 7 bits is read at a time. The sticking information 58 may be added either after or before the input gradation information 59.

Figure 5:
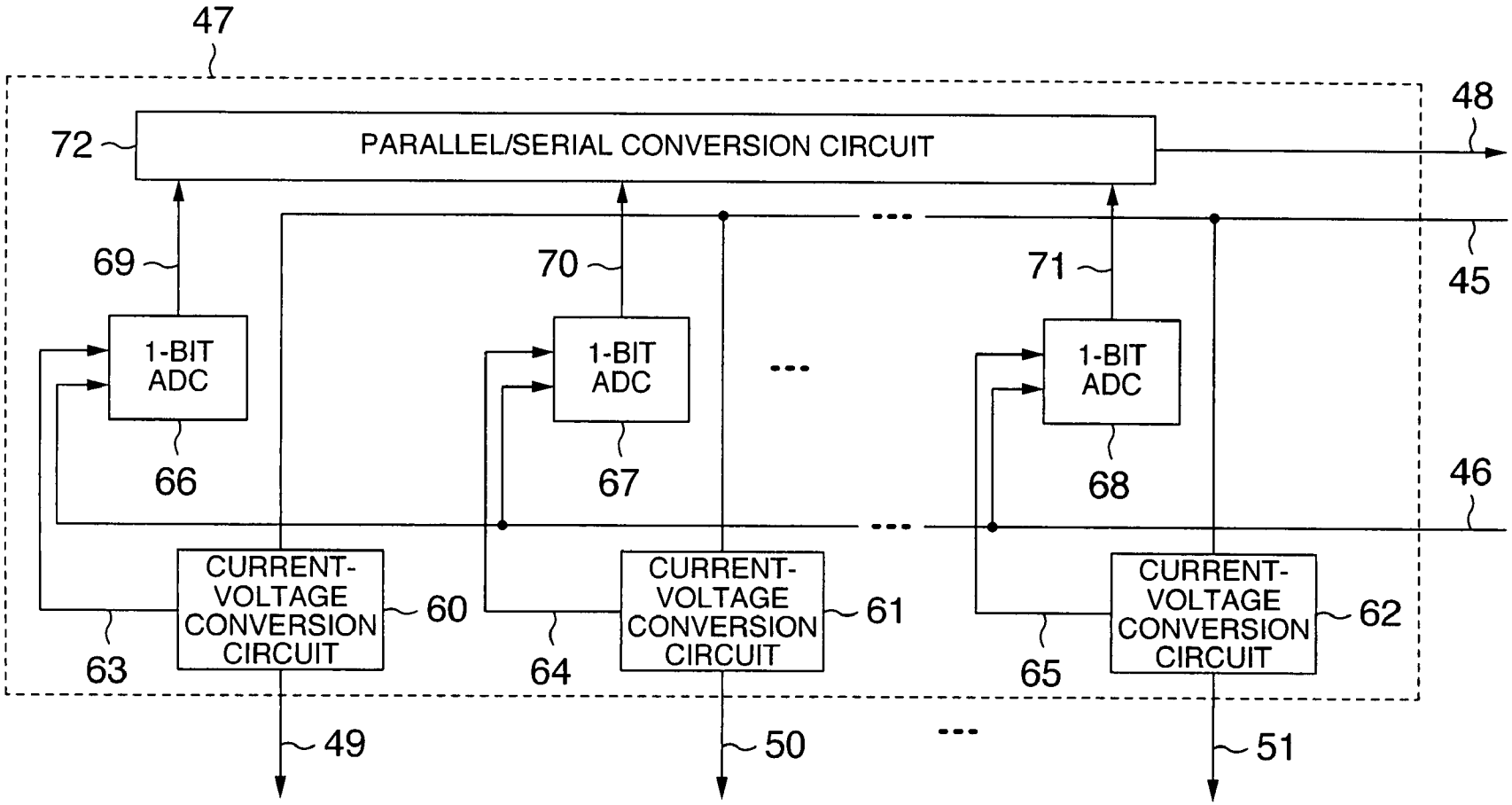
FIG. 5 shows the internal configuration of a current comparison circuit 47 of FIG. 3 according to an embodiment.

FIG. 5 shows the internal configuration of the current comparison circuit 47 of FIG. 3 according to an embodiment. In FIG. 5, numeral 60 designates a column-1 R current-voltage conversion circuit, numeral 61 a column-1 G current-voltage conversion circuit, numeral 62 a column-240 B current-voltage conversion circuit, numeral 63 a column-1 R current-voltage conversion value, numeral 64 a column-1 G current-voltage conversion value, and numeral 65 a column-2 B current-voltage conversion value. The column-1 R current-voltage conversion circuit 60, the column-1 G current-voltage conversion circuit 61 and the column-240 B current-voltage conversion circuit 62 convert the amount of the current flowing from the emission power supply 45 to the column-1 R emission-power-supply 49, the column-1 G emission power supply 50 and the column-240 B emission power supply 51, respectively, into the corresponding voltages, and outputs them as the column-1 R current-voltage conversion value 63, the column-1 G current-voltage conversion value 64 and the column-240 B current-voltage conversion value 65, respectively. In other words, each current-voltage conversion circuit is a detection circuit for detecting the amount of the current flowing in the emission power supply of each column and each color.

Numeral 66 designates a column-1 R current ADC, numeral 67 a column-1 G current ADC, numeral 68 a column-240 B current ADC, numeral 69 a column-1 R current comparison result, numeral 70 a column-1 G current comparison result, numeral 71 a column-240 B current comparison result, and numeral 72 a parallel/serial conversion circuit. The column-1 R current ADC 66, the column-1 G current ADC 67 and the column-240 B current ADC 68 compare the column-1 R current-voltage conversion value 63, the column-1 G current-voltage conversion value 64 and the column-240 B current-voltage conversion vale 65, respectively, with a current reference 46, and in the case where any of the former is larger, outputs a "1" signal from the corresponding ADC as the column-1 R current comparison result 69, the column-1 G current comparison result 70 and the column-240 B current comparison result 71, respectively. Specifically, each ADC is a comparator for comparing each current value (voltage value) with a corresponding reference. Each ADC preferably outputs the current comparison result for each one horizontal scanning period, i.e. each operation of the scanning line drive circuit 8. The parallel/serial conversion circuit 72 converts the column-1 R current comparison result 69, the column-1 G current comparison result 70 and the column-240 B current comparison result 71 output as a parallel signal into a serial signal and outputs it as a current comparison result 48.

Figure 6:
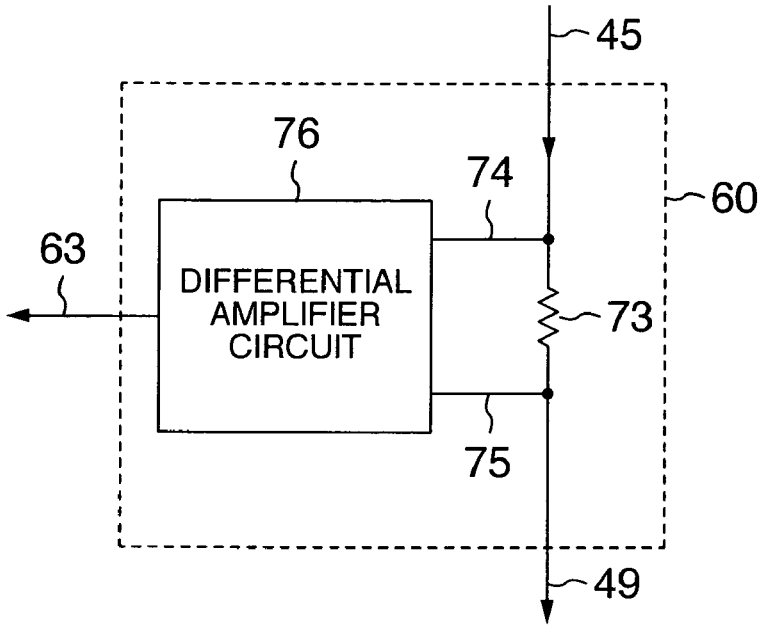
FIG. 6 shows the internal configuration of a column-1 R current-voltage conversion value 63 of FIG. 5 according to an embodiment.

FIG. 6 shows the internal configuration of the column-1 R current-voltage conversion value 63 of FIG. 5 according to an embodiment. The column-1 G current-voltage conversion value 64 and the column-240 B current-voltage conversion value 65 also have a similar configuration. In FIG. 6, numeral 73 designates a current-voltage conversion resistor, numeral 74 a detected high voltage and numeral 75 a detected low voltage. The current-voltage conversion resistor 73 converts the amount of the current flowing from the emission power supply 45 to the column-1 R emission power supply into a voltage and outputs the result as a potential difference between the detected high voltage 74 and the detected low voltage 75. Numeral 76 designates a differential amplifier circuit for amplifying the potential difference between the detected high voltage 74 and the detected low voltage 75 and outputs the result as the column-1 R current-voltage conversion value 63.

Figure 7:
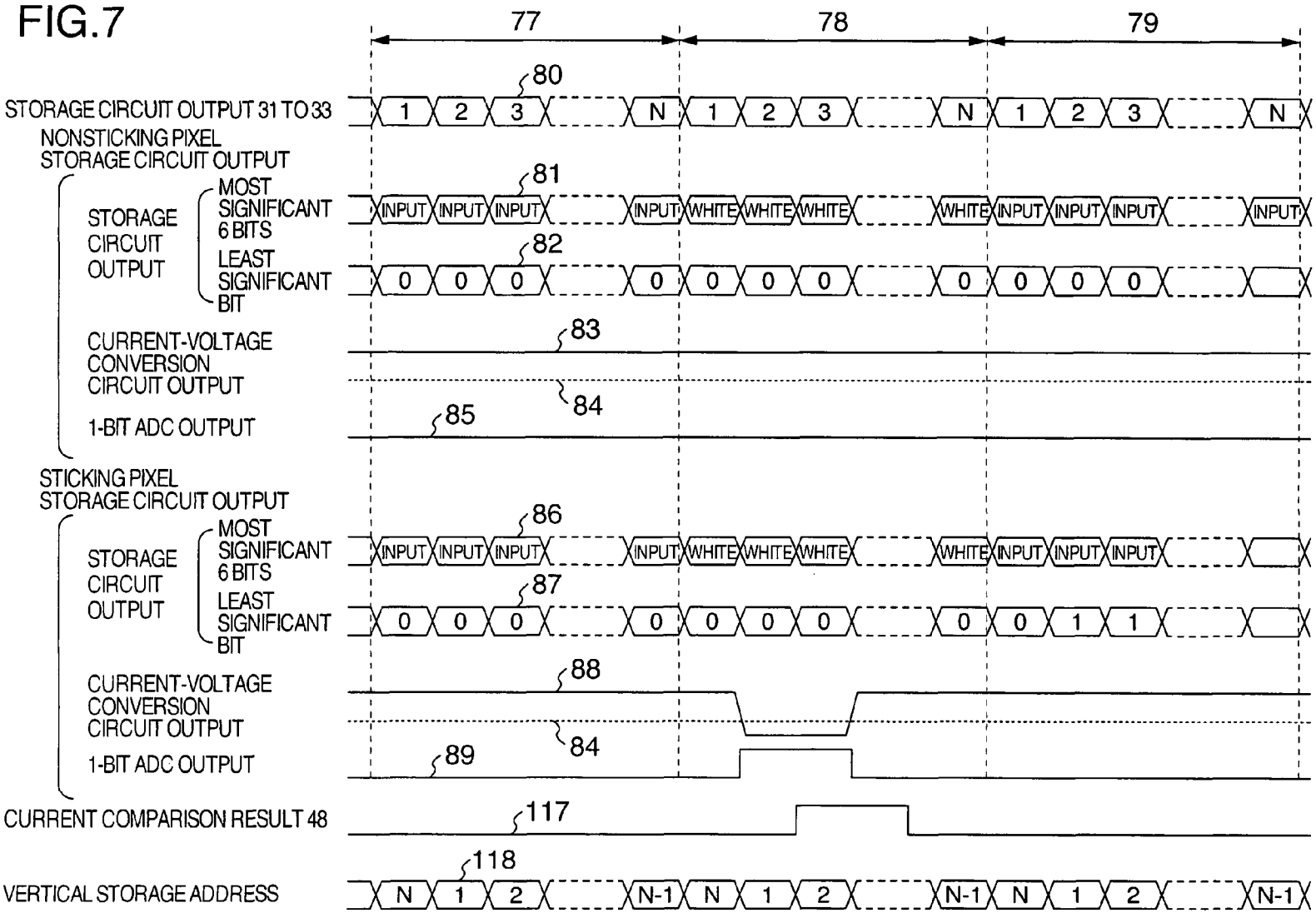
FIG. 7 shows the operation of generating the oscillation, during the sticking detection period, of the data line drive circuit having the current change compensating function of FIG. 1.

FIG. 7 shows the oscillation generating operation of the data line drive circuit having the current change compensating function of FIG. 1 during the sticking detection period according to an embodiment. In FIG. 7, numeral 77 designates a pre-sticking detection display period, numeral 78 a sticking detection period, numeral 79 a post-sticking detection period and numeral 80 a storage circuit output waveform. The storage circuit output waveform 80 indicates that the data of rows 1 to N are sequentially output in each period. According to this embodiment, character N is assumed to be 320 rows by way of explanation. Numeral 81 designates the output waveform of the most significant 6 bits of the storage circuit at the time of nonsticking, numeral 82 an output waveform of the least significant bit (one bit) of the storage circuit at the time of nonsticking, numeral 83 a current-voltage conversion output waveform at the time of nonsticking, numeral 84 a current reference level, and numeral 85 a 1-bit ADC output waveform the at the time of nonsticking. In the output waveform 81 of the most significant 6 bits of the storage circuit at the time of nonsticking, the 6-bit data of rows 1 to 320 input from the system are output. The nonsticking current-voltage conversion output waveform 83, undergoing no current change at the time of nonsticking, is higher than the current reference level 84 associated with the determination of sticking generation, while the nonsticking 1-bit ADC output waveform 85 remains at "0". The least significant bit 82 of the nonsticking storage circuit is always output as "0". Numeral 86 designates the most significant 6-bit output waveform of the storage circuit with sticking, numeral 87 the least significant bit output waveform of the storage circuit with sticking, numeral 88 a current-voltage conversion output waveform with sticking, and numeral 89 a 1-bit ADC output waveform with sticking. The most significant 6-bit output waveform 86 of the storage circuit with sticking, input as the 6-bit data of rows 1 to 320 from the system and output with or without sticking, assumes a similar waveform to the most significant 6-bit output waveform 81 of the storage circuit with no sticking. In the current-voltage conversion output waveform 87 with sticking, on the other hand, the current is reduced with sticking and assumes a lower level than the current reference level for determining the sticking generation. In the case under consideration, the sticking is assumed to be generated on rows 2 and 3. Under this condition, the 1-bit ADC output waveform 89 with sticking assumes the value "1", and therefore the least significant bit 87 of the storage circuit with sticking is output as a "1" signal on rows 2 and 3. Numeral 117 designates a current comparison result output waveform, and numeral 118 a vertical storage address waveform. The current comparison result output waveform 117 is derived from such detected 1-bit ADC output waveform 89 with being delayed for a period of time required for one line in order to perform both a parallel to serial conversion and a storage operation during the succeeding line. Thus, the vertical storage address waveform 118 also has an address with being delayed for a period of time required for one line.

Figure 8:
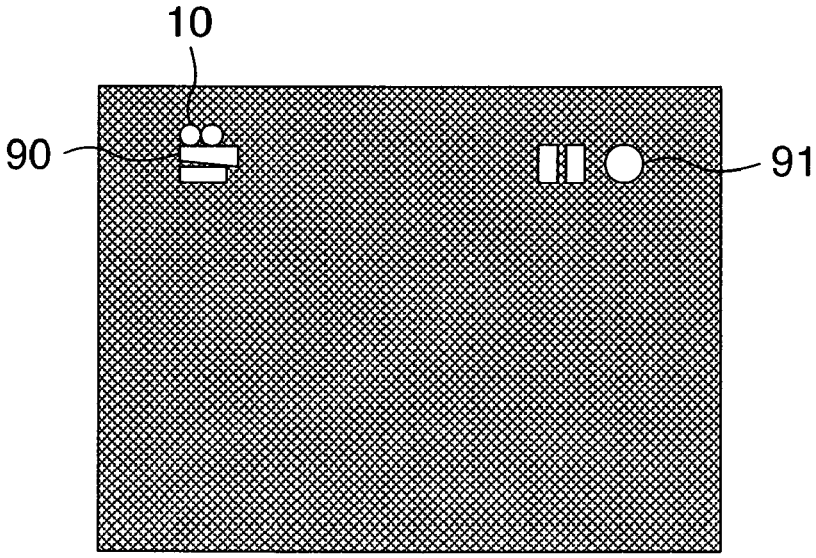
FIG. 8 shows a display example liable to cause the sticking of a fixed pattern in the display of the self-emission display 10 of FIG. 1.

FIG. 8 shows an example of display of the self-emission display 10 of FIG. 1 in which the sticking of a fixed pattern is liable to occur. In FIG. 8, numeral 90 designates an operation mode icon, and numeral 91 an operation state icon. The operation mode icon 90 indicates that the DSC or the mobile phone is in the state of dynamic image display, while the operation state icon 91 indicates the actual operation state such as the dynamic image pickup or stop. Both icons are displayed for a long time at a predetermined position, often causing the sticking of a fixed pattern.

With reference to FIGS. 1 to 9, the control operation at the time of sticking detection according to this embodiment is explained.

First, the flow of display data is explained with reference to FIG. 1. In FIG. 1, the data line drive circuit having the current change compensating function 2 temporarily stores the display data of the display signal 1 and in conformity with the display timing of the self-emission display 10, generates, at the time of normal display, the data line drive signal 3 and the scanning line control signal 5 corresponding to the display data, while at the same time outputting, as the emission source voltage 4, the voltage for light emission of the self-emission element from the emission control voltage 7 output by the emission voltage generating circuit 6. At the time of sticking detection, on the other hand, the data line drive signal 3 is output as the total white display for detection and the sticking is detected by comparison with the reference voltage in the emission control voltage 7. Although the sticking detection is displayed in total white according to this embodiment, the invention is not limited to this embodiment. At the time of sticking detection, the brightness reduction due to the sticking is compensated for an the data line drive signal 3 is generated and output, as the detail thereof is explained later. The scanning line drive circuit 8 outputs the scanning line drive signal 9 to control the scanning select line of the self-emission display 10. Finally, in the self-emission element display 10, the pixels on the scanning line selected by the scanning line drive signal 9 emit light in accordance with the signal voltage of the data line drive signal 3 and the emission source voltage 4, as the detail thereof is explained later.

With reference to FIGS. 2 to 8, the sticking detection and the compensation operation of the data line drive circuit having the current change compensation function 2 and the scanning line drive circuit 21 shown in FIG. 1 are explained in detail.

In FIG. 3, the interface control circuit 27 operates similarly to the conventional version. The storage circuit 30, like in the prior art, stores the write data 28 in accordance with the address control signal 29 while at the same time storing the current change storage data 54 constituting the result of detecting the current change caused by the sticking during the sticking detection period. The read operation is performed in accordance with the display timing of the self-emission element display 10, and the data for 720 columns from the column-1 R read data 31 and the column-1 G read data 32 to the column-240 B read data 33 are output.

In FIG. 4A, the write data 28 are stored in the area of the input gradation information 59 and the current change storage data 54 in the area of the sticking information 58, each in the number of dots corresponding to the horizontal arrangement 56 by the vertical arrangement 57, which are collectively read out as one pixel information 55 at the time of the read operation shown in FIG. 4B. At the time of sticking generation, therefore, the current change storage data 54 is added into the sticking compensated data.

In FIG. 3, at the time of normal display, like in the prior art, the timing control circuit 34 and the latch circuit 37 latch one line of the read data from the storage circuit 30 and to assure the total white display during the sticking detection period, latches one line of the white display data in accordance with the sticking detection timing signal 36, which are output as the column-1 R latch data 38 and the column-1 G latch data 39 to the column-240 B latch data 40. The D/A conversion circuit 41, like in the prior art, converts the digital data including the column-1 R latch data 38, the column-1 G latch data 39 and the column-240 B latch data 40 into analog data, and outputs them as the column-1 R data line drive signal 42 and the column-1 G data line drive signal 43 to the column-240 B data line drive signal 44. The input digital data is the sticking compensated data, and therefore the D/A conversion circuit, though exactly identical with the conventional one, outputs the sticking compensated analog data. In the process, the least significant bit of the data is always "0" before sticking compensation and always "1" after compensation. The analog data, therefore, can be corrected by an amount equivalent to the resolution of 7 bits, i.e. one gradation of the 128-gradation display. Assuming that the white display is 100%, the brightness is compensated by 0.8%, and generally, the sticking recognized by the brightness reduction of 1% can be compensated with the brightness reduction of 0.8% or less. The current comparator circuit 47, in total white display mode during the sticking detection period, detects the current amount for supplying the emission power 45 to the self-emission elements on each column and compares it with the current reference 46. In the case where the current value is reduced below the current reference 46, a sticking generation is determined and a "1" signal is output as the current comparison result 48. The current change storage control circuit 52, in order to store the current comparison result 48 at the detected display position, generates the current change storage address control signal to be stored in the storage circuit 30 from the sticking detection timing signal 36.

In FIG. 5, the column-1 R current-voltage conversion circuit 60, the column-1 G current-voltage conversion circuit 61 up to the column-240 B current-voltage conversion circuit 62 convert the amount of the current flowing in the column-1 R emission power supply 49, the column-1 G emission power supply 50 and the column-240 B emission power supply 51, respectively, from the emission power supply 45 into a voltage, and output them as the column-1 R current-voltage conversion value 63, the column-1 G current-voltage conversion value 64 and the column-240 B current-voltage conversion value 65, respectively. In the self-emission element, the current amount and the emission brightness are proportional to each other, and therefore the converted current amount represents the emission brightness, i.e. the sticking state. The smaller the current amount, i.e. the lower the emission brightness, the larger the degree of sticking.

In FIG. 6, the differential amplifier circuit 76 amplifies the amount of the current flowing in each column of the emission power supply 45 as converted into a voltage by a current-voltage conversion resistor 73. In the case where the current is detected pixel by pixel as in this embodiment, the current is so small that an amplifier circuit is required. In the case where the current is detected for a wider area, i.e. for a plurality of pixels collectively resulting in a large current amount, on the other hand, the amplifier circuit can be done without.

In FIG. 5, the column-1 R current ADC 66, the column-1 G current ADC 67 and the column-240 B current ADC 68 compare the column-1 R current-voltage conversion value 63, the column-1 G current-voltage conversion value 64 and the column-240 B current-voltage conversion value 65, respectively, with a current reference 46 indicating the sticking generation level, and in the case where any of the former is larger, a "1" signal is output as a column-1 R current comparison result 69, a column-1 G current comparison result 70 and a column-240 B current comparison result 71, respectively. The parallel/serial conversion circuit 72 converts the parallel output of the column-1 R current comparison result 69, the column-1 G current comparison result 70 and the column-240 B current comparison result 71 into a serial signal and outputs a current comparison result 48. According to this invention, the current-voltage conversion circuit and the current ADC are arranged for each column. Nevertheless, they can alternatively be arranged one each for each source of the emission power supply 45 so that the pixels are turned on one by one and the current is compared with a reference. In this way, the current-voltage conversion circuits and the current ADC can be reduced in number on the one hand and the parallel/serial conversion circuit 72 can be eliminated at the same time.

In FIG. 7, the storage circuit output waveform 80 sequentially outputs the data of rows 1 to 320 during each period. In the case where no sticking is detected during the sticking detection period 78, the most significant 6-bit output waveform 81 of the storage circuit at the time of no sticking is output as the 6-bit data of rows 1 to 320 input from the system, while the current-voltage conversion output waveform 83 at the time of no sticking remains unchanged, and is higher than the current reference level 84 constituting the level for determining the sticking generation. Also, the 1-bit ADC output waveform 85 at the time of no sticking remains at "0". Therefore, the least significant 6-bit 82 of the storage circuit at the time of no sticking always outputs a "0" signal. Upon detection of a sticking, on the other hand, the most significant 6-bit output waveform 86 of the storage circuit is output as the 6-bit data of rows 1 to 320 input from the system regardless of sticking, and assumes a waveform similar to the most significant 6-bit output waveform 81 of the storage circuit without sticking. The current-voltage conversion output waveform 87 with sticking, on the other hand, is lower than the current reference level 84 for determining the sticking generation on rows 2 and 3 where the sticking is generated, and the associated 1-bit ADC output waveform 89 with sticking assumes "1". Thus, the least significant bit 87 of the storage circuit with sticking is output as "1" in rows 2 and 3. The "1" signal output on rows 2 to 3 is serially converted by the parallel/serial conversion circuit 72 of FIG. 5 on rows 3 and 4, respectively. Correspondingly, the serially converted signal is stored in the storage circuit 30 at the address corresponding to the current change storage address control signal 53 (vertical storage address 117 and the horizontal storage address omitted) generated by the current change storage control circuit 52 shown in FIG. 3. According to this embodiment, the operation in horizontal direction is explained on the assumption that the sticking is generated on rows 2 and 3 in vertical direction. As explained with reference to FIG. 5, however, the provision of the current comparator circuit for each column of course makes it possible to specify the pixel where the sticking is generated on the same row such as row 2 of column N in horizontal direction.

In FIG. 2, assume that the data write switch 21 is turned on through the first row select line 15. The data signal voltage is accumulated in the write capacitor 22 through the first dot R data line 11, and the current corresponding to the voltage accumulated in the write capacitor is supplied by the drive transistor 23 to the organic EL 24. In the process, the current supply power makes up the emission power 45 supplied through the column-1 R emission power supply line 13.

Also, the current detection display pattern according to this embodiment is not limited to the pixel-by-pixel total white display of the whole screen, but as shown in FIG. 8, only the portion where the sticking easily occurs can be displayed to detect the current. In this case, the capacitance of the current detection circuit and the storage circuit can also be reduced.

According to the first embodiment of the invention described above, the current can be compared for an arbitrary display pattern, and various degenerations can be detected for each pixel or area with a small circuit size. By storing the result in the form with bits added to the input display pattern and correcting the display data, the storage capacity can be suppressed and the fixed sticking pattern can be obviated using the conventional D/A converter.

Second Embodiment

A second embodiment of the invention is explained in detail below with reference to the drawings.

Figure 9:
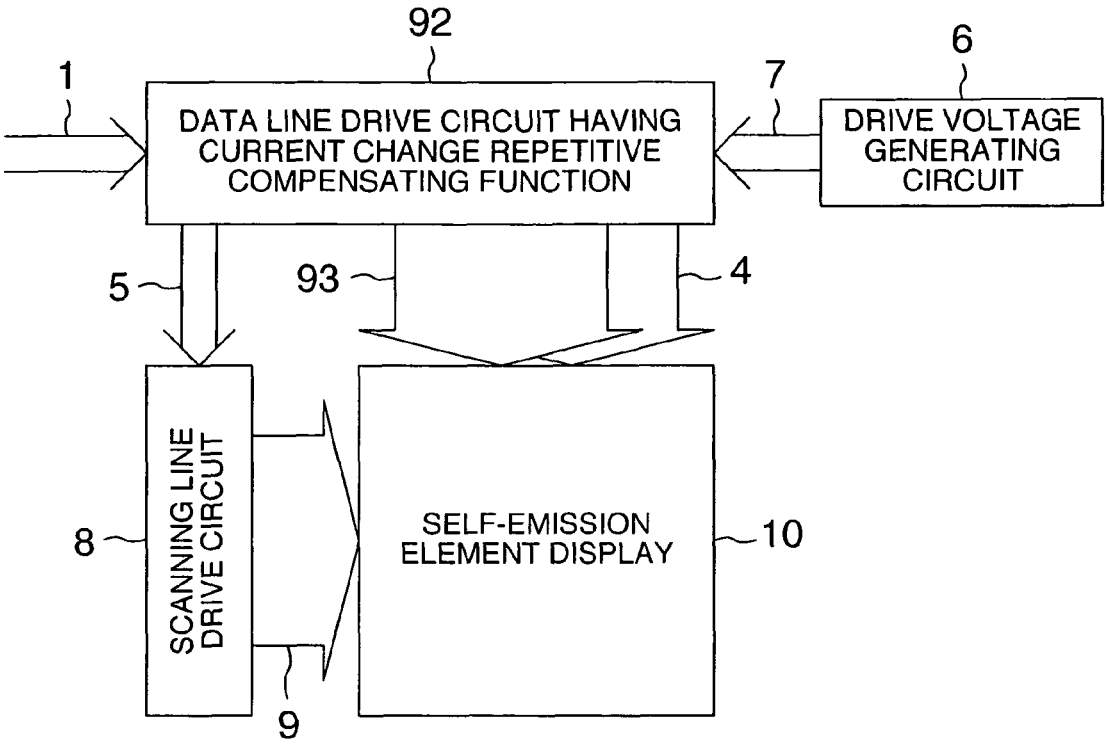
FIG. 9 shows an example of the self-emission type display device according to an embodiment of the invention.

FIG. 9 shows an example of the self-emission element display device according to an embodiment of the invention. In FIG. 9, the component parts designated by reference numerals similar to those of FIG. 1 are similar to and operate in similar fashion to those of the first embodiment. Numeral 92 designates a data line drive circuit having a current change repetitive compensation function, and numeral 93 a current change repetitive compensation data line drive signal. The data line drive circuit having the current change repetitive compensation function 92, operating substantially similarly to the corresponding circuit of the first embodiment, has the feature that unlike in the first embodiment, the sticking is compensated not once but a plurality of times. The other display operation is similar to that of the first embodiment.

Figure 10:
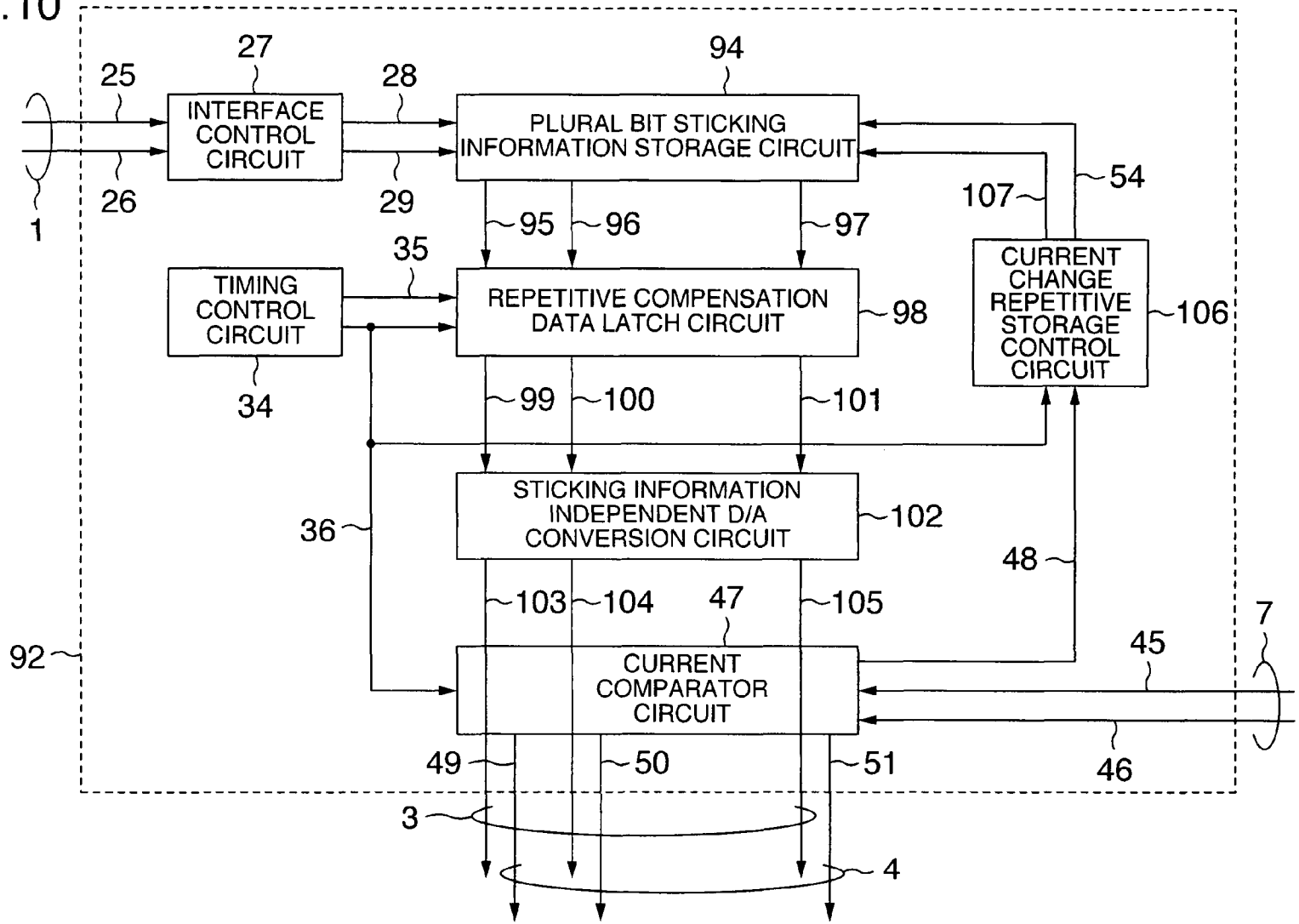
FIG. 10 shows the internal configuration of a data line drive circuit having the current change repetitive compensating function 92 of FIG. 9 according to an embodiment.

FIG. 10 shows the internal configuration of the data line drive circuit having the current change repetitive compensation function 92 of FIG. 9 according to an embodiment. In FIG. 10, the component parts designated by similar reference numerals to those in FIG. 3 are similar and operate similarly to the corresponding parts of the first embodiment. Numeral 94 designates a plural bit sticking information storage circuit, numeral 95 a repetitive compensation column-1 R read data, numeral 96 a repetitive compensation column-1 G read data, and numeral 97 a repetitive compensation column-240 B read data. The plural bit sticking information storage circuit 94, unlike in the first embodiment, has the sticking information portion in a plurality of bits instead of one bit. The repetitive compensation column-1 R read data 95, the repetitive compensation column-1 G read data 96 and the repetitive compensation column-240 B read data 97 also, unlike in the first embodiment, have the sticking information portion in a plurality of bits instead of one bit. Numeral 98 designates a repetitive compensation data latch circuit, numeral 99 a repetitive compensation column-1 R latch data, numeral 100 a repetitive compensation column-1 G latch data and numeral 101 a repetitive compensation column-240 B latch data. The operation of the repetitive compensation data latch circuit 98 is similar to that of the first embodiment except for the number of data bits. Numeral 102 designates a sticking information independent D/A conversion circuit, numeral 103 a repetitive compensation column-1 R data line drive signal, numeral 104 a repetitive compensation column-1 G data line drive signal, and numeral 105 a repetitive compensation column-240 B data line drive signal. The sticking information independent D/A conversion circuit 102, though similar to the conventional one according to the invention, is separated into the D/A for the input data portion and the D/A for the sticking information portion. The repetitive compensation column-1 R data line drive signal 103, the repetitive compensation column-1 G data line drive signal 104 and the repetitive compensation column-240 B data line drive signal 105 constitute analog data with the separated D/A conversion results added thereto. Numeral 106 designates a current change repetitive storage control circuit, and numeral 107 a current change repetitive storage address control signal. The current change repetitive storage control circuit 106, which generates the address with the current change detected and stores it once in the first embodiment, generates the current change repetitive storage address control signal 107, as well as the address, according to this embodiment in such a manner that in the case where the sticking is generated again after a current change compensation and another current change occurs, the detection result is stored in a different sticking information bit.

Figure 11A:
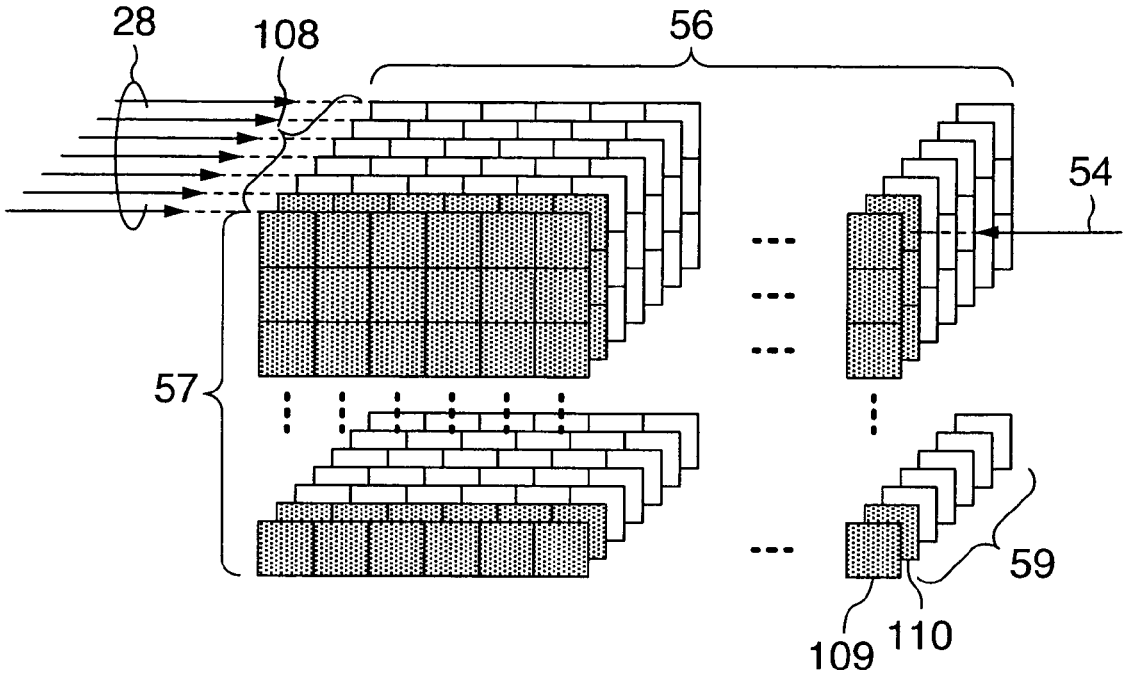
FIGS. 11A and 11B show the memory bit structure of a current change repetitive storage circuit 94 of FIG. 10 according to an embodiment.
Figure 11B:
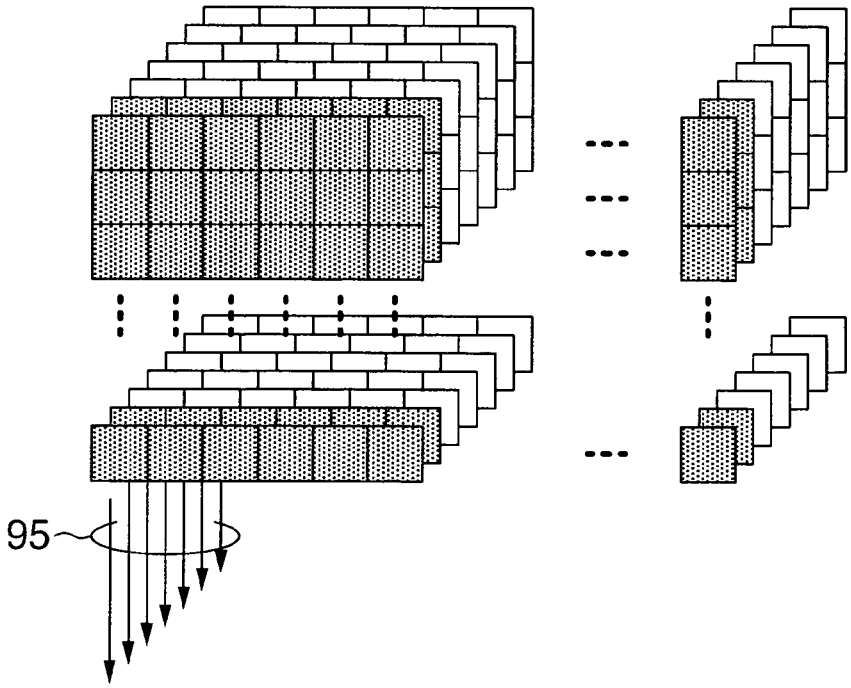

FIGS. 11A and 11B show a memory bit structure of the current change repetitive storage circuit 94 of FIG. 10 according to an embodiment, in which FIG. 11A shows the write operation and the FIG. 11B the read operation. In FIG. 11, the component parts designated by similar reference numerals to those in FIG. 4 are similar to the corresponding component parts of the first embodiment. Numeral 108 designates the repetitive storage one-pixel information, numeral 109 the first sticking information and numeral 110 the second sticking information. The repetitive storage one-pixel information 108 corresponds to the output gradation information of one pixel of display, and in the description that follows according to this embodiment, is assumed to be 8 bits. As in the first embodiment, the horizontal arrangement 56 corresponds to the number of dots in horizontal direction of display, which according to this embodiment is assumed to be 720 dots, while the vertical arrangement 57 corresponds to the number of dot in vertical direction of display, which according to this embodiment, is assumed to be 320 dots in the description that follows. Also, the repetitive storage one-pixel information 108 is divided into the first sticking information 109, the second sticking information 110 and the input gradation information 59. At the time of write operation, as in the first embodiment, the write data 28 is stored in the input gradation information 59. In the case where the current change storage data 54 is detected at the first session, the write data 28 is written in the first sticking information 109, and in the case where the current change storage data 54 is detected at the second session, on the other hand, the write data 28 is written in the second sticking information 110. At the time of read operation, in contrast, 8 bits are collectively read out as the repetitive compensation column-1 R read data 95. According to this embodiment, therefore, it is assumed that the current change due to the sticking can be compensated twice in the description that follows.

Figure 12:
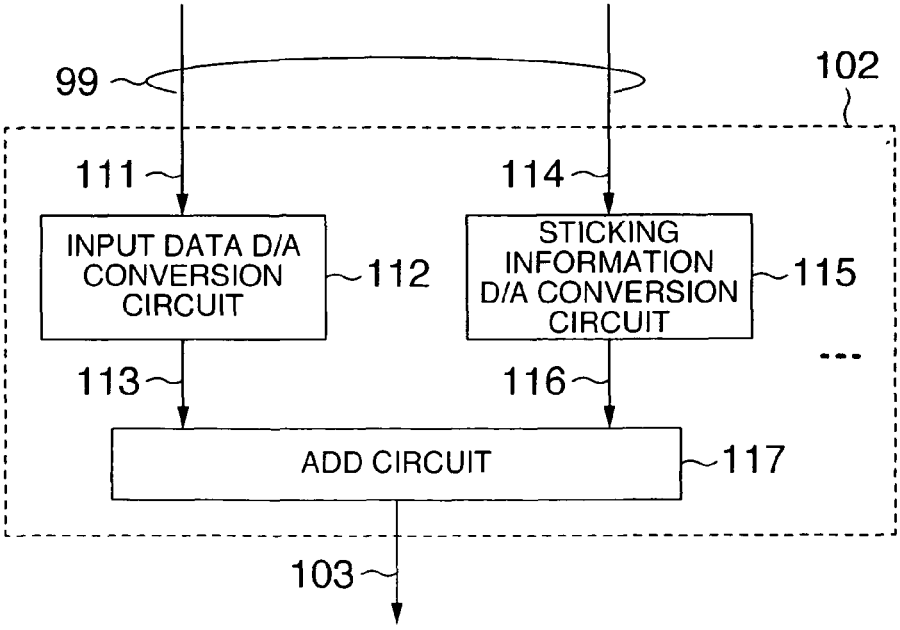
FIG. 12 shows the internal configuration of a sticking information independent D/A conversion circuit 102 of FIG. 10 according to an embodiment.

FIG. 12 shows the internal structure of the sticking information independent D/A conversion circuit 102 of FIG. 10 according to an embodiment. In FIG. 12, numeral 111 designates the input data information included in the repetitive compensation column-1 R latch data 99, numeral 112 the input data D/A conversion circuit, and numeral 113 the input analog conversion data. The input data D/A conversion circuit 112, like the conventional A/D conversion circuit, converts the input data information 111 into analog data and outputs it as an input analog conversion data 113. Numeral 114 designates sticking compensation information, numeral 115 a sticking information D/A conversion circuit, and numeral 116 a sticking compensation analog data. The sticking information D/A conversion circuit 115 determines an analog conversion value proportional to the number of bits "1" of the 2-bit sticking compensation information 114 and outputs it as the sticking compensation analog data 11. These circuits, in a set of three, make up the D/A converter for one column. This embodiment, therefore, includes the D/A converter for 720 columns. In the description that follows, the 2-bit sticking compensation information 114 assumes the form of "01" for the first sticking compensation, and "11" for the second sticking compensation. Also, the sticking information D/A conversion circuit 115 is assumed to generate the sticking compensation analog data 116 for brightness compensation of 1% for the input "01" and 2% for the input "11".

With reference to FIGS. 9 to 12, the control operation for sticking detection according to this embodiment is explained.

First, with reference to FIG. 9, the flow of the display data is explained. In FIG. 9, the circuits designated by the same reference numerals as in FIG. 1 have a similar configuration and operation to the corresponding circuits of the first embodiment. The data line drive circuit having the current change repetitive compensation function 92, like in the first embodiment, temporarily stores the display data of the display signal 1. In accordance with the display timing of the self-emission element display 10, the data line drive circuit having the current change repetitive compensation function 92 generates the current change repetitive compensation data line drive signal 93 and the scanning line control signal 5 corresponding to the display data and outputs the voltage for light emission of the self-emission element as an emission source voltage 4 from the emission control voltage 7 output from the emission voltage generating circuit 6 in normal display mode. In sticking detection mode, on the other hand, the current change repetitive compensation data line drive signal 93 is output in total white display for detection and the sticking is detected by comparison with the reference voltage of the emission control voltage 7. Also in this embodiment, like in the first embodiment, the total white display is used for sticking detection. Nevertheless, this invention is not limited to it. At the time of sticking detection, unlike in the first embodiment, the brightness reduction due to sticking is compensated and in the case where the sticking is detected again after compensation, a further compensation is conducted thereby to generate and output the current change repetitive compensation data line drive signal 3. According to this embodiment, the aforementioned compensation is effected twice, to which the invention is not limited, as the detail is described later. The emitting operation of the scanning line drive circuit 8 and the self-emission element display 10 is similar to that of the first embodiment.

With reference to FIGS. 10 to 12, a plurality of the sticking detection and compensation sessions of the data line drive circuit having the current change repetitive compensation function 92 shown in FIG. 1 are explained in detail below.

In FIG. 10, the circuits designated by the same reference numerals as those in FIG. 3 have similar configuration and operation to those of the first embodiment. A plural bit sticking information storage circuit 94, like in the first embodiment, stores the write data 28 in accordance with the address control signal 29 on the one hand and holds the bits capable of storing, a plurality of times, the current change storage data 54 providing the result of the current change caused by the sticking during the sticking detection period on the other hand.

In FIGS. 11A and 11B, the circuits designated by the same reference numerals as those in FIGS. 4A and 4B have a similar configuration to those of the first embodiment. With regard to the current change storage data 54, the first detection result is stored in the area of the first sticking information 109, and upon repeated sticking detection, the second detection result is stored in the area of the second sticking information 110 each in the number of dots corresponding to the horizontal arrangement 56 by the vertical arrangement 57. At the time of read operation, these information are read collectively as the repetitive storage one-pixel information 108. At the time of sticking in this stage, therefore, the current change storage data 54 is added thereby making up the sticking compensation-data. Thus, the sticking compensation in two sessions is possible.

In FIG. 10, the repetitive compensation data latch circuit 98 performs the latch operation at the same control timing as in the first embodiment, the only difference being the number of bits of the input data including the repetitive compensation column-1 R read data 95, the repetitive compensation column-1 G read data 96, the repetitive compensation column-240 B read data 97 and the output data including the repetitive compensation column-1 R latch data 99, the repetitive compensation column-1 G latch data 100 and the repetitive compensation column-240 B latch data 101. The sticking information independent D/A conversion circuit 102 is separated into the input data D/A conversion circuit and the sticking information D/A conversion circuit by the plural bit sticking information storage circuit 94.

In FIG. 12, the input data D/A conversion circuit 112 is similar to the D/A conversion circuit according to the first embodiment, and the sticking information D/A conversion circuit 115 converts the sticking compensation information 114 of the repetitive compensation column-1 R latch data 99 to analog data in a way different from the input data D/A conversion circuit 112. For example, the input D/A conversion circuit 112 converts the 6-bit data into analog data, and therefore the brightness changes by about 1.6% for each change of "1" of the least significant bit. In the sticking information D/A conversion circuit 115, on the other hand, the 2 bits "01" are converted into analog data for the first sticking compensation and the 2 bits "11" into analog data for the second sticking compensation. Assuming that the visible brightness reduction due to the sticking is 1%, therefore, the brightness change is assumed as 1% for "01" and 2% for "11". According to this embodiment, the input bits are assumed to be 6 bits, the sticking information to be 2 bits and the brightness is compensated by 1% in one sticking compensation. Nevertheless, the invention is not limited to these numbers of bits, the number of times the sticking is compensated or the brightness compensation %, and the input data of 8 bits is also realizable. Further, the number of times the sticking is compensated can be increased by increasing the number of bits of the sticking information, and the sticking can be compensated more strictly by narrowing the percentage of brightness compensation.

In FIG. 10, assuming that the total white display prevails during the sticking detection period, the current comparison circuit 4, having a similar configuration to that of the first embodiment, detects the amount of the current when supplying the emission power 45 to the self-emission elements of each column and compares it with a current reference 46. In the case where the current value is lower than the current reference 46, it is determined that a sticking is generated, and a "1" signal is output as the current comparison result 48. According to this embodiment, in the case where the current value is reduced below the current reference 46 again thereafter, a sticking case is determined, and a "1" signal is output as the current comparison result 48. Then, the current change repetitive storage control circuit 106 performs the control operation to store the current comparison result 48 in each storage bit in the first and second sessions as described above. Also in this case, the number of times the current comparison result 48 is stored is not limited by the invention, and can be increased by increasing the address control.

Both the first and second embodiments have a circuit for temporarily storing the input data. In the case where the display data of the system is displayed directly, however, the storage circuit can be configured of only the sticking information storage portion by deleting the input data storage portion.

According to the second embodiment of the invention described above, the current can be compared for an arbitrary display pattern, and various degeneration can be detected for each pixel or each area with a small circuit size. This result is stored by adding bits to the input display data and the display data is corrected a plurality of times, thereby making it possible to obviate a more protracted sticking.

This invention can obviate the sticking of a fixed pattern and therefore can be suitably used for the display devices such as DVC (digital video camera) and DSC (digital still camera) in which the icon display is essential.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A self-emission type display device comprising:

a display panel including a plurality of data lines, a plurality of scanning lines crossing the data lines, a plurality of power lines and a plurality of self-emission pixels connected to the data lines, the scanning lines and the power lines;

a data line drive circuit for applying a drive signal to the data lines;

a scanning line drive circuit for applying a drive signal to the scanning lines, and for selecting pixels to be driven;

a display control circuit for generating a control signal to control the data line drive circuit and the scanning line drive circuit based on input display data and a timing signal;

a voltage generating circuit for generating a drive voltage to be applied to the power lines;

a current detection circuit for detecting a current flowing through a pixel having been affected due to sticking, and for comparing an amount of the current detected with a reference value supplied by the voltage generating circuit; and a storage circuit provided within the display control circuit;

wherein the storage circuit is arranged to store the display data with adding predetermined data if the amount of the current detected has a predetermined relationship with the reference value, the display data to be stored in the storage circuit including the predetermined data indicating a current change due to sticking stored separately from the other portion in the display data; and wherein the data line drive circuit determines a strength of the drive signal based on the inputted display data with the predetermined data, so that each of inputted display data with the predetermined data is outputted at a time through a corresponding pixel according to the strength of the drive signal having been determined, the display data with the predetermined data to be outputted at a time including a predetermined number of bits for each corresponding pixel.

2. The self-emission type display device according to claim 1, wherein a display position on the display panel to be detected by the current detection circuit is an entire area on the display panel.

3. The self-emission type display device according to claim 1, wherein a display position on the display panel to be detected by the current detection circuit is a predetermined partial area on the display panel.

4. The self-emission type display device according to claim 1, wherein the data line drive circuit includes:

a first analog conversion circuit for converting the display data into an analog value;

a second analog circuit for converting a current comparison result from the current detection circuit into an analog value; and an adder circuit for adding analog display data and an analog current comparison result.

5. The self-emission type display device according to claim 1, wherein the predetermined data to be added to the inputted display data shows a number of bits corresponding to a number of times detected by the display control circuit.

6. The self-emission type display device according to claim 1, wherein the predetermined relationship shows that the amount of the current detected is smaller than the reference value.

7. The self-emission type display device according to claim 1, wherein the predetermined data comprises 1-bit data.

8. The self-emission type display device according to claim 1, wherein the predetermined number of bits for each corresponding pixel comprises seven.

9. A self-emission type display device comprising:

a display panel including a plurality of data lines, a plurality of scanning lines crossing the data lines, a plurality of power lines and a plurality of self-emission pixels connected to the data lines, the scanning lines and the power lines;

a data line drive circuit for applying a drive signal to the data lines;

a scanning line drive circuit for applying a drive signal to the scanning lines, and for selecting pixels to be driven;

a voltage generating circuit for generating a drive voltage to be applied to the power lines;

a current detection circuit for detecting a current flowing through a pixel having been affected due to sticking, and outputting 1-bit data indicating a change in current due to sticking when the current is smaller than the current detected with a reference value supplied by the voltage generating circuit; and a correction circuit for adding the 1-bit data to the display data for storage, during a write operation, such that the display data to be stored includes the 1-bit data indicating the current change due to sticking stored separately from the other portion in the display data, and for subsequent output, during a read operation, such that the display data with the 1-bit data to be outputted includes a predetermined number of bits for each pixel.

10. The self-emission type display device according to claim 9, wherein the correction circuit adds the 1-bit data to the least significant bits of the display data.

11. The self-emission type display device according to claim 9, wherein the correction circuit adds the 1-bit data of the previous frame period to the display data for the next and subsequent frame periods.

12. The self-emission type display device according to claim 9, wherein:

the current detection circuit detects the current for each power line each time of scanning by the scanning drive circuit thereby to detect the current for each pixel, the 1-bit data indicates whether the current for each pixel is smaller than the reference value, and the correction circuit adds the 1-bit data to the display data for each pixel.

13. The self-emission type display device according to claim 9, wherein:

the current detection circuit outputs, each time of detection, 1-bit data indicating whether the current for each of the pixels is smaller than the reference value, and the correction circuit adds the bit data in a number of bits corresponding to a number of times detected by the current detection circuit to the display data.

14. The self-emission type display device according to claim 9, wherein:

the data line drive circuit generates a drive signal corresponding to the display data and a drive signal corresponding to the 1-bit data, and the correction circuit adds the drive signal corresponding to the 1-bit data to the drive signal corresponding to the display data.

15. The self-emission type display device according to claim 12, wherein the current detection circuit includes:

a detection circuit arranged for each of the power lines to detect the current for each of the power lines; and a comparator circuit arranged for each of the powers line to compare the current for each power line with the reference value each time of scanning by the scanning line drive circuit, and to output the current comparison result as the 1-bit data.

16. The self-emission type display device according to claim 15, wherein the current detection circuit includes a conversion circuit for converting the 1-bit parallel data output from each comparison circuit into serial data.

17. The self-emission type display device according to claim 15, wherein:

the detection circuit converts the current for each of the power lines into a voltage value; and the comparator circuit compares the voltage value for each of the power lines with the reference value and outputs the voltage comparison result as the 1-bit data.

18. A self-emission type display device comprising:

a display panel including a plurality of data lines, a plurality of scanning lines crossing the data lines, a plurality of power lines and a plurality of self-emission pixels connected to the data lines, the scanning lines and the power lines;

a data line drive circuit to apply a drive signal to the data lines;

a scanning line drive circuit to apply a drive signal to the scanning lines, and to select pixels to be driven;

a display control circuit arranged to control the data line drive circuit and the scanning line drive circuit based on input display data and a timing signal;

a voltage generating circuit arranged to generate a drive voltage to be applied to the power lines;

a current detection circuit arranged to detect a current flowing through a pixel having been affected due to sticking, and to make a comparison between an amount of the current detected with a reference value supplied by the voltage generating circuit; and a storage circuit provided within the display control circuit, to store the display data with predetermined data if the amount of the current detected has a predetermined relationship with the reference value, the display data to be stored including the predetermined data indicative of a current change due to sticking stored separately from the other portion in the display data, wherein the data line drive circuit determines a strength of the drive signal based on the inputted display data with the predetermined data, so that each of inputted display data with the predetermined data is outputted through a corresponding pixel according to the strength of the drive signal, the display data with the predetermined data to be outputted including a predetermined number of bits for each pixel.

19. The self-emission type display device according to claim 18, wherein a display position on the display panel to be detected by the current detection circuit is an entire area on the display panel or a predetermined partial area on the display panel.

20. The self-emission type display device according to claim 18, wherein the predetermined data to be added to the inputted display data shows a number of bits corresponding to a number of times detected by the display control circuit.

21. The self-emission type display device according to claim 18, wherein the predetermined data comprises 1-bit data.

* * * * *